US007018165B2

(12) United States Patent
Milazar

(10) Patent No.: US 7,018,165 B2
(45) Date of Patent: Mar. 28, 2006

(54) METHOD OF MINIMIZING THE GAP BETWEEN A ROTATING TURBINE BLADE AND A CASING OF A TURBINE, A TURBINE, AND A METHOD OF DETERMINING THE WEAR BEHAVIOR OF A WHEEL OF A ROTOR

(75) Inventor: Mirko Milazar, Oberhausen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/962,934

(22) Filed: Oct. 12, 2004

(65) Prior Publication Data

US 2005/0079048 A1 Apr. 14, 2005

(30) Foreign Application Priority Data

Oct. 13, 2003 (EP) ..... 03023207

(51) Int. Cl.
*F01D 11/14* (2006.01)

(52) U.S. Cl. ..... 415/1; 415/131; 415/173.1; 324/699; 324/701

(58) Field of Classification Search ..... 415/118, 415/173.1, 173.4, 174.4, 1, 131; 416/61; 324/421, 691, 699, 701
See application file for complete search history.

(56) References Cited

U.S. PATENT DOCUMENTS

| | | | | |
|---|---|---|---|---|
| 4,804,905 | A | 2/1989 | Ding et al. | |
| 4,813,273 | A * | 3/1989 | Parsons | 73/118.1 |
| 2003/0215323 | A1 | 11/2003 | Prinz et al. | |

FOREIGN PATENT DOCUMENTS

| | | |
|---|---|---|
| DE | 39 10 319 C2 | 10/1989 |
| DE | 39 01 167 A1 | 7/1990 |
| DE | 42 23 495 A1 | 1/1994 |
| DE | 43 15 125 A1 | 11/1994 |
| GB | 1094780 | 12/1967 |
| GB | 2 063 477 A | 6/1981 |
| WO | WO 99/28598 | 6/1999 |
| WO | WO 00/28190 | 5/2000 |

* cited by examiner

*Primary Examiner*—Ninh H. Nguyen

(57) ABSTRACT

Method of minimizing the gap between a wheel and a casing of a turbine, a turbine, and a method of determining the wear behavior of a wheel of a rotor. To minimize the gap between a wheel and a casing in a turbine, optical methods are also often used in order to minimize the gap. However, this is very expensive. The method according to the invention proposes that the wheel and the casing (be part of an electric circuit, so that an electrical parameter, such as resistance for example, can be measured, the value of which shows whether a contact is present.

13 Claims, 4 Drawing Sheets

METHOD OF MINIMIZING THE GAP BETWEEN A ROTATING TURBINE BLADE AND A CASING OF A TURBINE, A TURBINE, AND A METHOD OF DETERMINING THE WEAR BEHAVIOR OF A WHEEL OF A ROTOR

CROSS REFERENCE TO RELATED APPLICATION

This application claims priority of the European application No. 03023207.8 EP filed Oct. 13, 2003 under the European Patent Convention and which is incorporated by reference herein in its entirety.

FIELD OF THE INVENTION

The invention relates to a method of minimizing the gap between a wheel and a casing of a turbine according to the preamble the claims and to a turbine according to the preamble of the claims and to a method of determining the wear behavior of a wheel of a rotor as claimed in the claims.

BACKGROUND OF THE INVENTION

In a turbine, such as a steam or gas turbine for example, a rotor having at least one disk and a plurality of blades rotates inside a casing. There is a gap between the blade end and the casing.

Methods of displacing rotor and wheel have been disclosed by DE 42 23 495 and WO 00/28190.

In order to achieve a high efficiency, the gap between blade end and casing is to be minimal.

Methods of minimizing the gap have been disclosed by DE 39 10 319 C2 and DE 39 01 167A1.

However, the methods require considerable outlay in terms of equipment and/or are not very accurate, so that further optimization is desirable.

SUMMARY OF THE INVENTION

It is therefore an object of the invention to show a method with which the gap between wheel and casing is minimized in a simple manner.

The object is achieved by a method as claimed in the claims by the wheel and the casing being part of an electric circuit, so that a mechanical contact is determined with the establishing of an electrical contact.

It is likewise an object of the invention to show a turbine in which the gap between wheel and casing is minimal.

The object is achieved by a turbine as claimed in the claims by the wheel and the casing being part of an electric circuit.

It is also an object of the invention to show a method of determining the wear behavior of a wheel.

The object is achieved by a method as claimed in the claims by the wheel and the casing being part of an electric circuit, so that a mechanical contact is determined with the establishing of an electrical contact.

If the end of a blade of a wheel wears, the distance between blade end and casing increases. This can be determined by the method as claimed in the claims by the characteristic curve of the change in distance with respect to time being determined.

Further advantageous measures are listed in the subclaims.

The measures listed in the subclaims may be advantageously combined with one another.

DETAILED DESCRIPTION OF THE INVENTION

Figure 1:
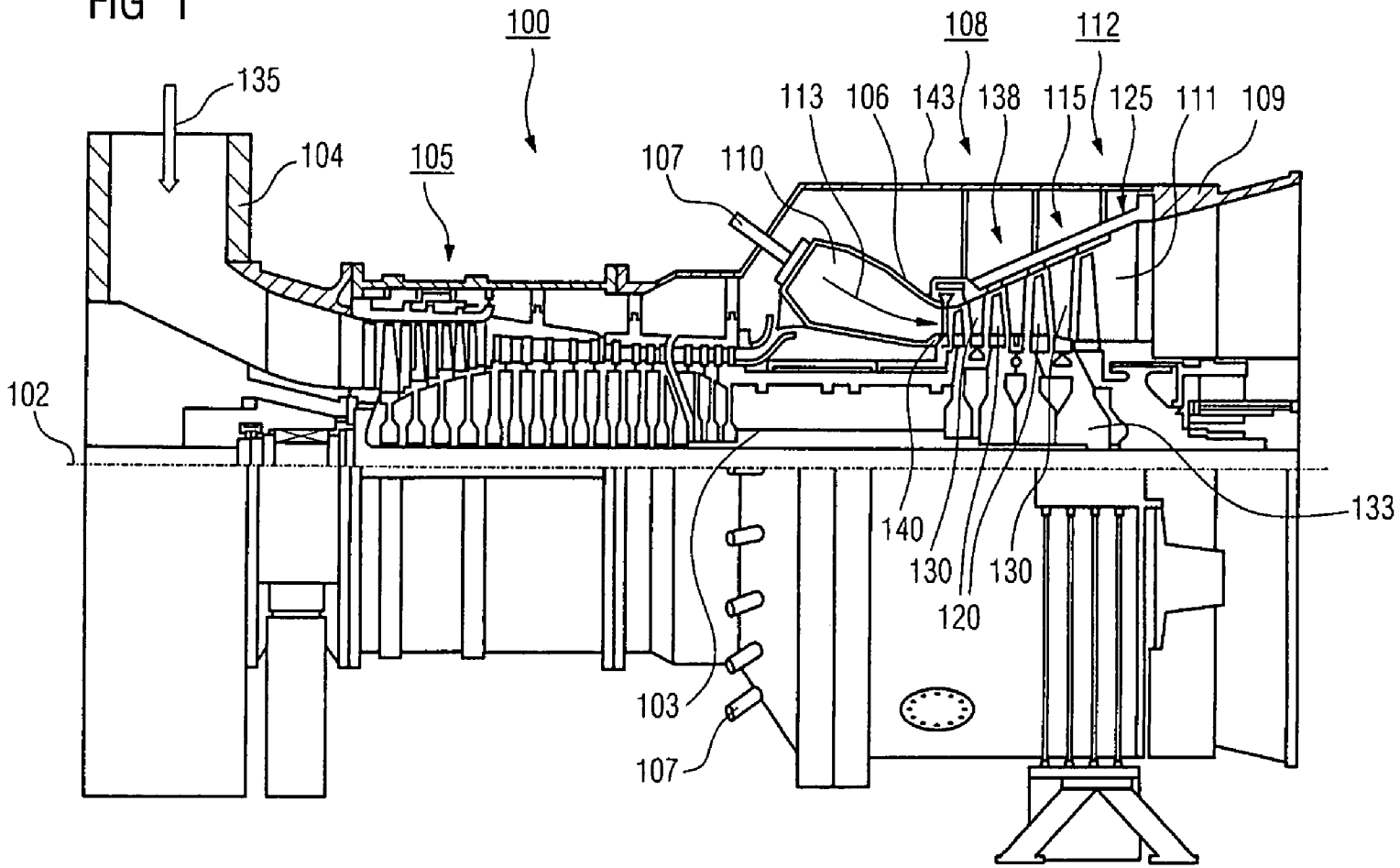
FIG. 1 shows a gas turbine.

FIG. 1 shows a gas turbine 100 in a longitudinal partial section.

In the interior, the gas turbine 100 has a rotor 103 which is rotatably mounted about a rotation axis 102 (axial direction) and is also designated as turbine wheel. Following one another along the rotor 103 are an intake casing 104, a compressor 105, a, for example toroidal, combustion chamber 110, in particular an annular combustion chamber 106, having a plurality of coaxially arranged burners 107, a turbine 108 and the exhaust-gas casing 109. The annular combustion chamber 106 communicates with a, for example annular, hot-gas duct 111. The turbine 108 is formed there by, for example, four turbine stages 112 arranged one behind the other. Each turbine stage 112 is formed from two blade rings. As viewed in the direction of flow of a working medium 113, a row 125 formed from moving blades 120 follows a guide-blade row 115 in the hot-gas duct 111.

In this case, the guide blades 130 are fastened to the stator 143, whereas the moving blades 120 of a row 125 are attached to the rotor 103 by means of a turbine disk 133. A generator or a driven machine (not shown) is coupled to the rotor 103.

During the operation of the gas turbine 100, air 135 is drawn in through the intake casing 104 and compressed by the compressor 105. The compressed air provided at the turbine-side end of the compressor 105 is passed to the burners 107 and is mixed there with a fuel. The mixture is then burned in the combustion chamber 110 while forming the working medium 113. From there, the working medium 113 flows along the hot-gas duct 111 past the guide blades 130 and the moving blades 120. The working medium 113 expands at the moving blades 120 in an impulse-transmitting manner, so that the moving blades 120 drive the rotor 103 and the latter drives the driven machine coupled to it.

The components exposed to the hot working medium 113 are subjected to thermal loads during the operation of the gas turbine 100. The guide blades 130 and moving blades 120 of the first turbine stage 112 as viewed in the direction of flow of the working medium 113, in addition to the heat shield blocks lining the annular combustion chamber 106, are subjected to the greatest thermal loading. In order to withstand the temperatures prevailing there, said guide blades 130 and moving blades 120 are cooled by means of a coolant. Likewise, the blades 120, 130 may have anti-corrosion coatings (MCrAlX; M=Fe, Co, Ni, X=Y, rare earths) and heat-resistant coatings (thermal insulating layer, for example ZrO2, Y2O4-ZrO2).

The guide blade 130 has a guide-blade root (not shown here) facing the inner casing 138 of the turbine 108 and a guide-blade tip opposite the guide-blade root. The guide-blade tip faces the rotor 103 and is secured to a fastening ring 140 of the stator 143.

Figure 2:
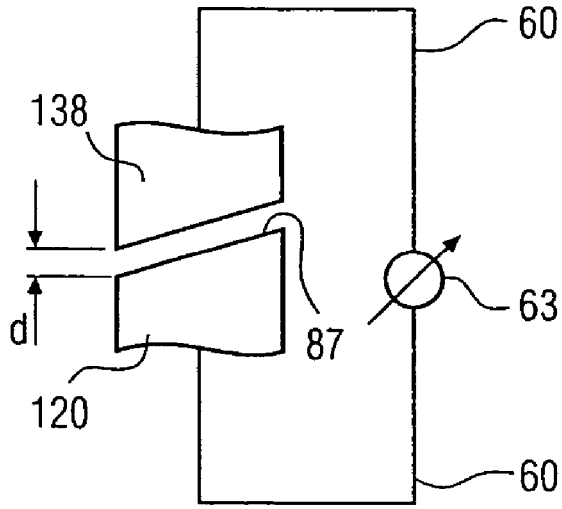
FIGS. 2, 3 show a casing with a wheel as part of an electric circuit.

FIG. 2 schematically shows an electric circuit between the wheel 120 and a casing 138.

In order to produce an electric circuit between a wheel 120, in particular a turbine blade 120, and a casing 138 of a steam or gas turbine 100, an electrical connection is made between the turbine blade 120 and the casing 138 by means of electric lines 60 or by means of electromagnetic transmission, for example via the shaft. An electric resistance and/or other electrical parameters can be measured by means of a corresponding measuring instrument 63 (voltmeter, ammeter, ohmmeter or capacitance meter).

For example, the electric resistance between at least one turbine blade 120 (shown schematically here) and the casing 138 can be measured.

If there is no contact between the turbine blade 120 and the casing 138, the electric resistance is very high or infinitely high.

If touching occurs between a blade tip 87 of the turbine blade 120 and the casing 138, an electrical contact is made between the turbine blade 120 and the casing 138, as a result of which the resistance is greatly minimized and the electric circuit is closed.

Depending on how large the contact area is between turbine blade 120 and the casing 138, the electric resistance changes. The measured electrical quantity is therefore a measure of the existing size of a gap d between blade tips and casing.

On account of the conicity of the tip of the wheel 120 and of the casing 138 relative to one another (FIG. 1, WO 00/28190), the gap d is reduced or increased by an axial displacement of the wheel 120 or of the casing 138.

Further electrical quantities which may be measured are the voltage or capacitance (direct current, alternating current, which is generally inversely proportional to the gap d) between both elements 120, 138. If a voltage is applied between wheel 120 and casing, no electric current flows as long as there is no mechanical contact.

If contact occurs between wheel 120 and casing 138 by axial displacement, a current flows, which can be measured, or a voltage drop is recorded.

Figure 3:
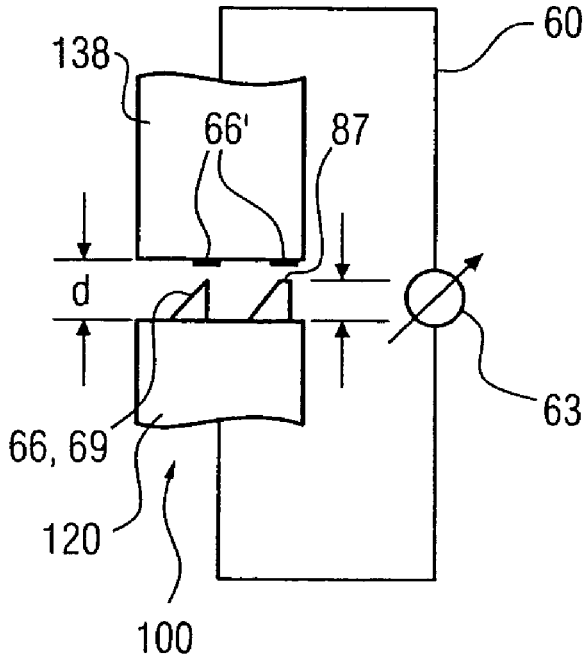

FIG. 3 shows a further exemplary embodiment of a turbine which is designed according to the invention and with which the method according to the invention can also be carried out. The conicity of the tip of the wheel 120 and of the casing 138 is not shown here.

The turbine blade 120 and the casing 138 are as a rule made of metallic material, so that they can conduct electric current.

However, the turbine blade 120 often has a ceramic coating, so that a flow of electric current would not be possible between turbine blade 120 and the casing 138. In these cases, an electric path between casing 138 and turbine blade 120, in particular the blade tip 87, must be made possible by other measures.

This is done, for example, by electrically conducting projections 69 which produce an electrical connection (FIG. 5) through the coating of the turbine blade 120 from the casing 138 to the turbine blade 120 and the electric line 60.

The projection 69 on the turbine blade 120 constitutes an electrical contact area 66 and is, for example, of triangular or conical design and can be worn by contact with the casing 138.

The projection 69 may be present on one or more turbine blades 120 of one or more turbine stages 112.

The at least one projection 69 is, for example, aligned with at least one electrical contact area 66 of the opposite casing 138.

The casing 138 may likewise have separately designed electrical contact areas 66 which have, for example, a high electrical conductivity and/or high wear resistance.

The turbine blades 120 may likewise have blade tips 87 according to the prior art which are designed for wear (abradables).

Figure 4:
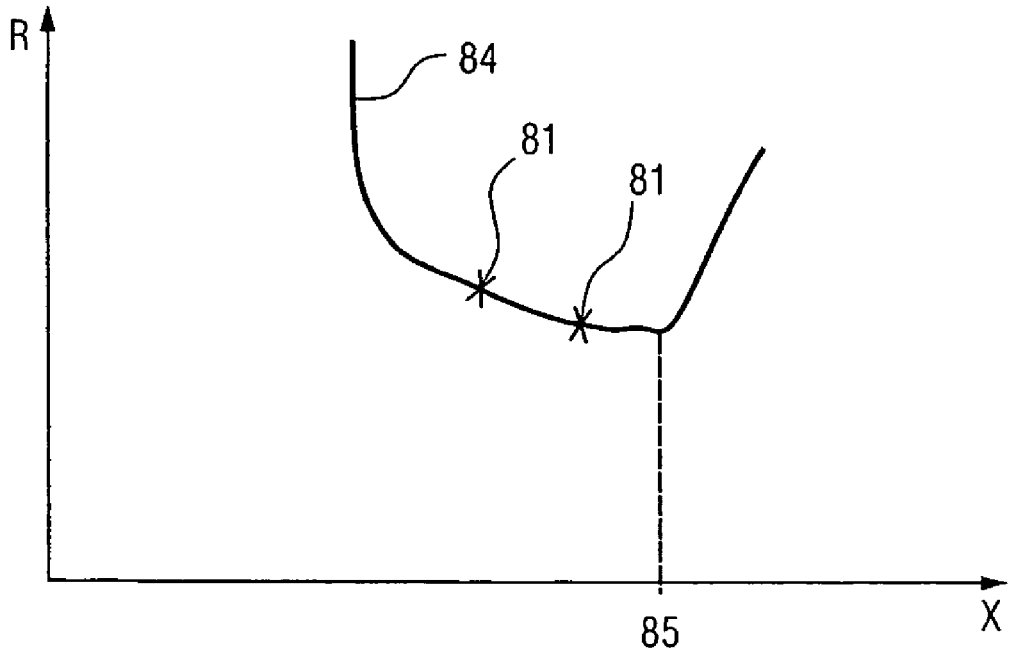
FIGS. 4, 6 show determined measuring curves.

In FIG. 4, the electric resistance R is plotted against an axial displacement of the moving blade 120 relative to the casing 138. The electric resistance R (or capacitance) stands for a certain gap d between casing 138 and the turbine blade 120.

The axial displacement is effected, for example, hydraulically by displacement of the rotor 103 together with the moving blades 120 in axial direction 102. On account of the conicity of the wheel tip and of the casing 138 (FIG. 1, WO 00/28190), the gap d is reduced as a result.

At the start, the electric resistance R has, for example, a certain value or is infinitely high.

By an axial displacement of the rotor 103 relative to the casing 138, the existing gap is narrowed and finally an electrical contact is produced, so that the resistance R drops. Depending on the axial displacement of the moving blades 120 relative to the casing 138, a more or less large contact area is produced between the turbine blades 120 and the casing 138, as a result of which the magnitude of the electric resistance R (or the capacitance) is also determined. Thus various measuring points 81 are obtained as a function of the value of the axial displacement.

The greater the axial displacement, the smaller the electric resistance. If an electrical contact has been produced, the moving blades 120 are shifted back again just until there is no longer any electrical contact (point 85 of the curve 84). A minimum gap is then set.

This setting of the minimum gap may be effected during operation, but also before start-up.

A curve 84 which serves to readjust the wheel 120 if the blade tip 87 wears can also be determined from the measured resistance values 81.

A final time at which a wear coating 75 (FIG. 5) on the turbine blade 120 is worn out can thus likewise be established.

Figure 6:
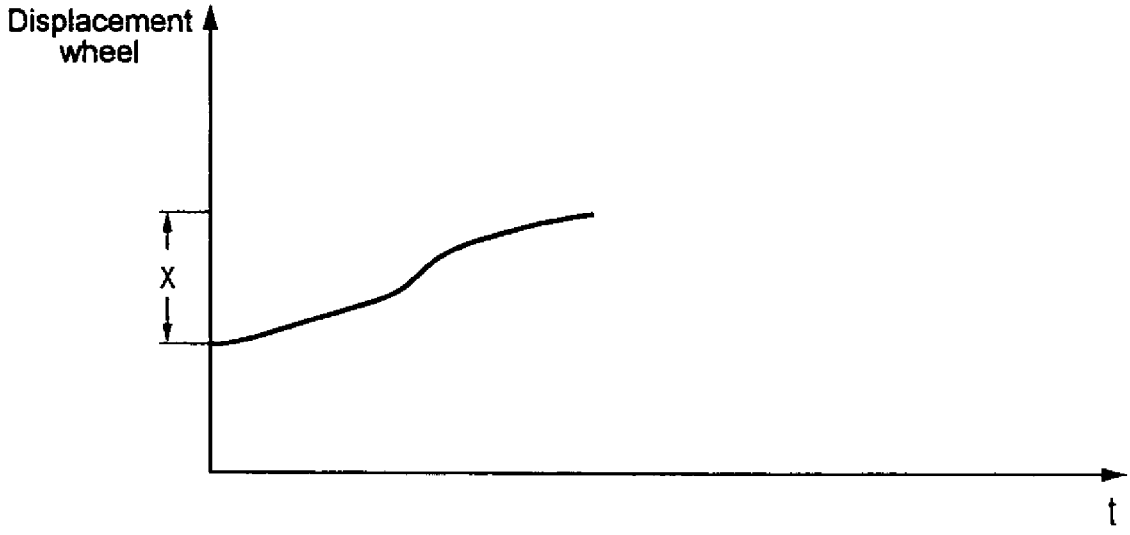

This is done by the distance x over which the rotor 103 has been readjusted relative to the casing 138 in order to set a certain minimum gap being determined continuously or intermittently by the time t. This results in a curve as shown in FIG. 6. This distance x corresponds to a certain loss of coating thickness. Since the coating thickness h of the coating 75 is known, the total distance of the readjustment x can determine when the coating 75 is worn out or how thick it still is.

Figure 5:
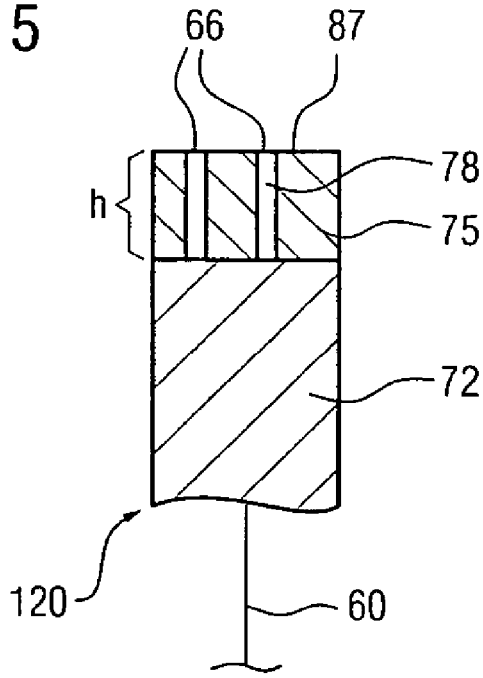
FIG. 5 shows part of a turbine blade.

FIG. 5 shows a turbine blade 120 of a turbine 100 designed according to the invention. The turbine blade 120 has a metallic substrate which (not shown) has a ceramic coating 75 and/or an outer wear coating 75. The outer wear coating 75 is, for example, porous and/or ceramic, so that there would actually be no electric path between the blade tip 87 and the metallic core 72 of the turbine blade 120.

At least one continuous electric path 78 is therefore produced in the anti-wear coating 75. The electric path 78 may be present in one or more turbine blades 120 of one or more blade rows.

The invention claimed is:

1. A method of minimizing a gap between a rotating turbine blade and a turbine casing, comprising:

adjusting the gap by displacing the rotating turbine blade and the turbine casing;

forming an electric circuit between the rotating turbine blade and the turbine casing;

measuring the gap via an electrical resistance in the electric circuit, wherein the electric resistance indicates that there is an electrical contact between the rotating turbine blade and the turbine casing; and setting a minimum gap based on the measured electrical resistance.

2. The method as claimed in claim 1, wherein an increased electric resistance indicates that there is decreased electrical contact between rotating turbine blade and the turbine casing.

3. The method as claimed in claim 1, wherein a voltage is applied between the rotating turbine blade and the turbine casing, the voltage being used as a measure of the size of the gap between wheel and casing.

4. The method as claimed in claim 1, wherein the rotating turbine blade is displaceable in an axial direction relative to the turbine casing to set the size of the gap.

5. The method as claimed in claim 4, wherein the wheel is displaced until there is no longer any electrical contact.

6. A gas turbine, comprising:

a rotating turbine blade;

a turbine casing adapted to make electrical contact with the blade;

an electric circuit comprising the rotating turbine blade and the turbine casing; and an amount of electric resistance in the electric circuit that indicates of the size of a gap between the rotating turbine blade and the turbine casing.

7. The turbine as claimed in claim 6, wherein the rotating turbine blade has a separate electrical contact area.

8. The turbine as claimed in claim 6, wherein the turbine casing has a separate electrical contact area.

9. The turbine as claimed in claim 8, wherein a projection is arranged on the rotating turbine blade to form the electrical contact area and the projection is the electrical contact between the rotating turbine blade and the turbine casing.

10. The turbine as claimed in claim 9, wherein the projection has a triangular or conical shape.

11. The turbine as claimed in claim 10, wherein the projection undergoes physical wear during operation of the turbine.

12. The turbine as claimed in claim 10, wherein the rotating turbine blade undergoes physical wear during operation of the turbine.

13. A method of determining wear behavior in the axial direction of a turbine blade, comprising:

creating an electric circuit between the turbine blade and a turbine casing;

measuring the size of the gap via an electrical resistance in the electric circuit, the electric resistance indicates that there is an electrical contact between the turbine blade and the turbine casing;

creating a measuring curve of an electric resistance plotted as a function of an axial displacement;

plotting a total distance of the axial displacement as a function of time; and determining a certain axial displacement corresponding to a certain wear of the rotating turbine blade.

* * * * *